US006367292B1

(12) United States Patent
Bunger

(10) Patent No.: US 6,367,292 B1
(45) Date of Patent: Apr. 9, 2002

(54) PADLOCK PROTECTOR

(75) Inventor: Richard E. Bunger, Tempe, AZ (US)

(73) Assignee: Mobile Mini, Inc., Tempe, AZ (US)

( * ) Notice: Subject to any disclaimer, the term of this patent is extended or adjusted under 35 U.S.C. 154(b) by 0 days.

(21) Appl. No.: 09/664,322

(22) Filed: Sep. 18, 2000

(51) Int. Cl.[7] ..... E05B 67/38
(52) U.S. Cl. ..... 70/56; 70/54; 292/148
(58) Field of Search ..... 70/54, 55, 56, 70/129, 2, DIG. 43, DIG. 56; 292/148

(56) References Cited

U.S. PATENT DOCUMENTS

| | | | | | |
|---|---|---|---|---|---|
| 185,043 | A | | 12/1876 | Osborn | |
| 229,332 | A | | 6/1880 | Pease | |
| 500,254 | A | | 6/1893 | Mayo | |
| 685,188 | A | | 10/1901 | Taylor | |
| 1,047,315 | A | | 12/1912 | Shone | |
| 1,428,367 | A | | 9/1922 | Forlander | |
| RE15,937 | E | | 10/1924 | Fritts | |
| 1,599,459 | A | | 9/1926 | Colombi et al. | |
| 2,974,987 | A | | 3/1961 | O'Brien | |
| 3,334,933 | A | | 8/1967 | Ehlers | |
| 3,695,657 | A | * | 10/1972 | Rosen | 292/57 |
| 3,731,506 | A | | 5/1973 | Greene et al. | |
| 3,850,014 | A | | 11/1974 | Flack | |
| 4,095,828 | A | | 6/1978 | East | |
| 4,214,783 | A | * | 7/1980 | Boegeman | 292/150 |
| 4,634,155 | A | | 1/1987 | Geringer et al. | |
| 4,641,506 | A | * | 2/1987 | Boucher | 70/129 |
| 4,655,487 | A | | 4/1987 | Korn et al. | |
| 4,866,960 | A | * | 9/1989 | Brower | 70/56 |
| 4,883,294 | A | | 11/1989 | Goodspeed | |
| 5,000,494 | A | * | 3/1991 | Guibleo | 292/148 |
| 5,261,258 | A | * | 11/1993 | Bunger | 70/56 |
| 5,458,383 | A | * | 10/1995 | Gunn | 292/148 |
| 5,518,281 | A | * | 5/1996 | Steward | 292/145 |
| 6,009,731 | A | * | 1/2000 | Emmons et al. | 70/56 |

FOREIGN PATENT DOCUMENTS

| | | |
|---|---|---|
| GB | 1135192 | 12/1968 |

* cited by examiner

*Primary Examiner*—B. Dayoan
*Assistant Examiner*—William Fee
(74) *Attorney, Agent, or Firm*—Frank J. McGue

(57) ABSTRACT

A protective device for locking two relatively movable objects of a cargo container in a fixed relationship comprises a housing having an open end and a flange extending about the periphery of the open end. The housing is mounted on one of said objects. A longitudinally movable bar is mounted on the interior of housing and extends therethrough for cooperatively engaging a sleeve mounted on the other of the objects for locking the objects together. A collar is also mounted within the housing for enclosing the bar. The collar has a padlock retainer formed between its ends for providing a recess which exposes a hole in the bar when the bar is in cooperative engagement with the sleeve. The recess forms an opening for receiving the shackle of a padlock while the hole is adapted to allow the shackle of the padlock to extend through the bar when the bar engages the sleeve. The collar also has a keyhole protector formed between its ends for providing a cavity which provides access to a key to a keyhole slot for locking and unlocking the padlock.

11 Claims, 2 Drawing Sheets

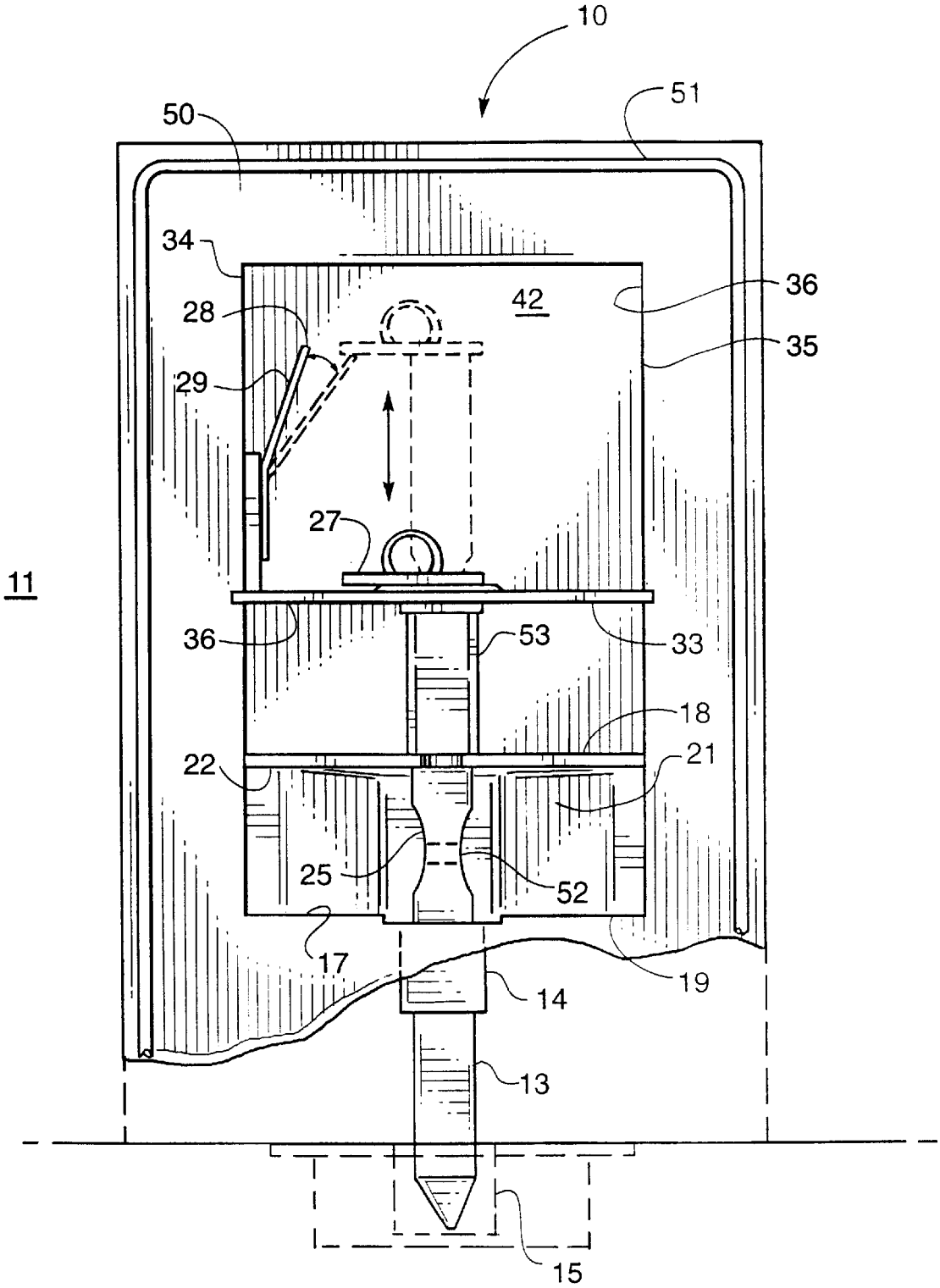
FIG, 4.

PADLOCK PROTECTOR

TECHNICAL FIELD

This invention relates to a protective device for a disk type padlock which is applied to interlocking parts at least one of which comprises a housing for enclosing a shiftable bar which housing is shaped to define a recess for receiving and covering the shackle of the disk type padlock and most of its housing when the shackle interlocks with the shiftable bar. The protective device is formed of steel to prevent access to the disk type padlock for severing purposes.

BACKGROUND OF THE INVENTION

Although the prior art shows protective devices for padlocks, none are believed to illustrate the type of device disclosed and claimed for protecting a padlock which is used to interlock relatively shiftable members of a locking system.

Various types of padlock protectors have been described in the patent literature.

U.S. Pat. No. Re15,937 entitled "Car Door Lock" which issued Oct. 28, 1924 to Fritts shows a car door lock which has a sliding bolt adapted to be securely fastened by transverse rivet which means for preventing easy removal of said rivet.

U.S. Pat. No. 1,047,315 entitled "Door Bolt" which issued on Dec. 17, 1912 to Shone provides a door bolt which is provided with means for securing the bolt to the door prevent manipulation of the bolt from outside the door.

U.S. Pat. No. 4,634,155 entitled "Power Actuated Door Locking And Monitoring Assembly" which issued on Jan. 6, 1987 to Geringer et al. shows a bolt slidably disposed in a door and lockset means in the door chamber.

U.S. Pat. No. 5,261,258 entitled "Padlock Protector" which issued on Nov. 16, 1993 to the present inventor discloses a security device which consists of an exterior mounted housing for a latch bar which defines a recess. The recess provides access to an aperture in the bar by a circular shackle of a disk shaped padlock. This device operates in much the same fashion as the present invention. However, it is also believed to be less effective because of its exterior mounting and structure allow some access to the locking mechanism and the shaft by drills and hammer devices.

None of the known prior art disclose the device set forth herein.

SUMMARY OF THE INVENTION

It is an object of this invention to provide an improved disk type padlock protector is provided which positions the lock and shackle of a disk type padlock in an inaccessible position to a cutting, drilling or prying tool.

It is a further object of this invention to provide an improved disk type padlock protector which prevents cutting access to a shiftable bar used to secure a door in the closed position.

It is still another object of this invention to prevent hammer access to a disk type padlock.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 4 shows a front cut away view of the present invention is a locked position with the unlocked position in shadow.

DESCRIPTION OF THE PREFERRED EMBODIMENT

Figure 1:
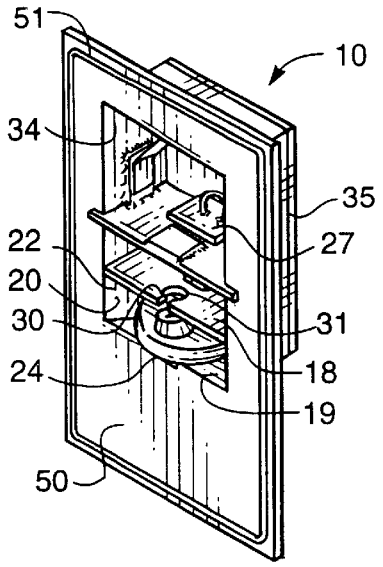
FIG. 1 is a perspective front and side view of one embodiment of the present invention with a disk type lock in place.

Referring more particularly to the drawings by characters of reference, FIGS. 1–4 disclose one embodiment of an improved padlock protector 10 used to lock two objects, usually at least one door 11 of a cargo storing container or other door assembly and the floor thereof. The free marginal part of door 11 carries a vertical hasp or bar 13 which moves longitudinally thereof to lock and unlock positions.

Bar 13 is mounted longitudinally in a lower collar 14 mounted the interior of door 11. Lower collar 14 is axially aligned with a keeper or sleeve 15 on a floor 12 so that bar 13 may be longitudinally moved into and out of the upper open end 16 of sleeve 15 to lock and unlock door 11.

Collar 14 is attached to a padlock retainer 17 formed at its end which comprises a pair of parallelly positioned plates 18 and 19 which, together with angled side plates 20 and 21, form an open recess 22 into which shackle 23 of a disk type padlock 24 may be inserted as shown in FIG. 1. Angled side plates 20 and 21 are designed to conform closely to the shape of padlock 24 and thus limit access to shackle 23 when locked.

In order for shackle 23 of padlock 24 to engage and interlock with bar 13 of protective device 10, a narrow portion 25 is provided in bar 13 having a hole 52 therethrough which is so positioned that shackle 23 can extend to and pass through hole 52 when bar 13 is in its lowest position as shown in FIG. 4.

Figure 2:
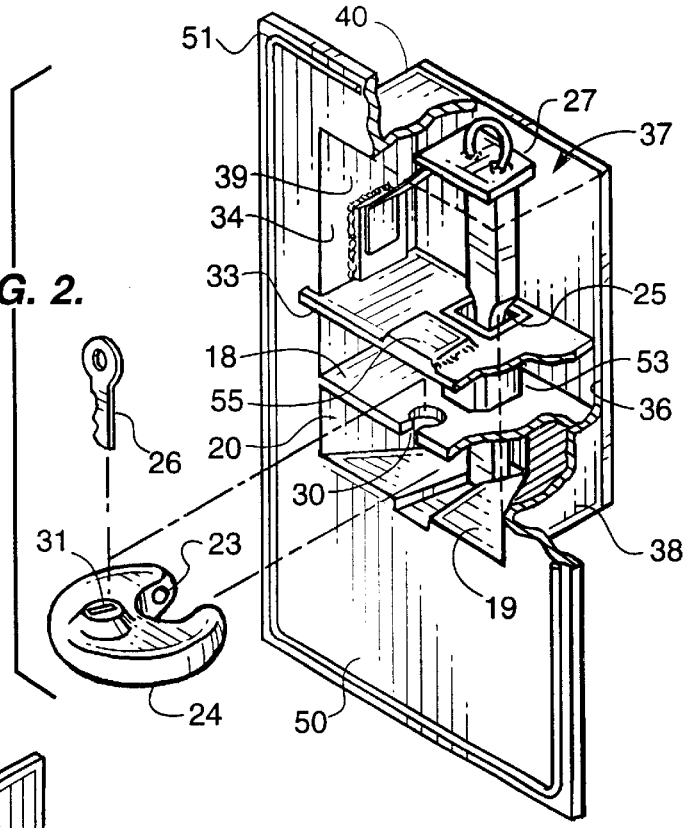
FIG. 2 is a perspective front and side view of the embodiment of FIG. 1 in an unlocked position.
Figure 3:
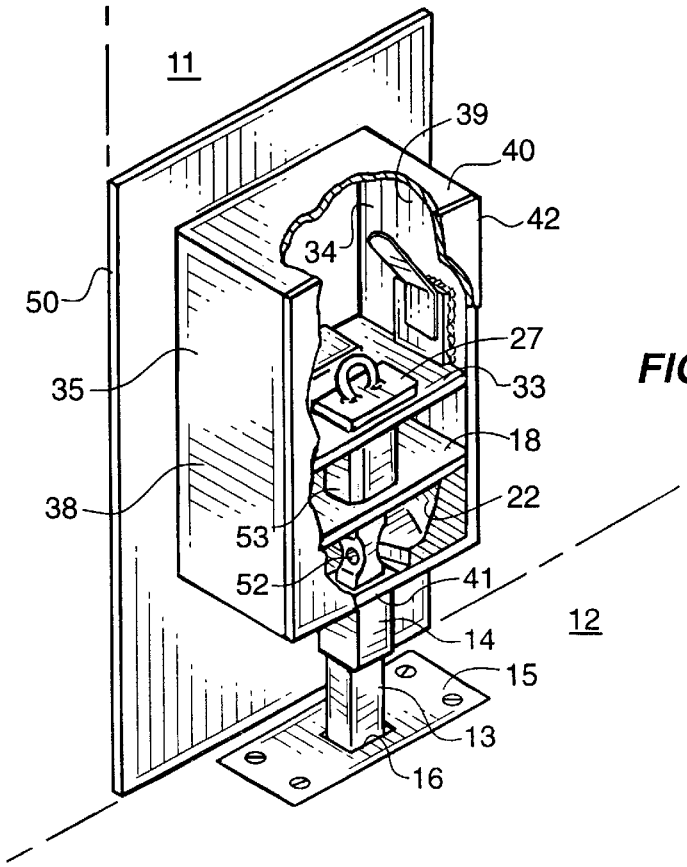
FIG. 3 shows a rear and side perspective cut away view showing the device of FIG. 1 in a locked position.

When circular shackle 23 is withdrawn from hole 52 of narrow portion 25 by actuation of a key 26 of padlock 24, bar 13 may be actuated longitudinally of lower collar 14 to the position shown in FIG. 2 to unlock door 11. A keyhole slot 30 is provided in plate 18 in a position corresponding to the location of keyhole 31 in disk type padlock 24.

An upper collar 53 extends between a keyhole protector plate 33 and plate 18 formed above padlock retainer cavity 17. Keyhole protector plate 33 and plate 18 in combination with straight side plates 34 and 35 form an open cavity 36. Open cavity 36 provides access for key 26 comp to be inserted via a keyhole slot 30 in plate 18 into a keyhole 31 of padlock 24. Plate 33 prevents direct access to keyhole 31 by any object, for example a drill, substantially longer than key 26. While such a drill could engage keyhole 31 at an angle, at such an angle the drill misses the tumblers thus leaving disk type padlock 24 in a locked position.

Further protection is provided by a solder bead patch 55 positioned directly above keyhole slot 30 on plate 33. Solder bead patch 55 is comprised of a hard facing rod solder which makes plate 33 virtually undrillable to prevent direct access to keyhole 31 of padlock 24.

To provide further protection, the entire device 10 is enclosed within a housing 37 being an open front, box like structure having two parallelly positioned sidewalls 38 and 39, a top sidewall 40 parallelly positioned to a bottom sidewall 41 and a rear plate 42. In the presently preferred embodiment, bottom sidewall 41 and plate 19 are equivalent and side plates 35 and 34 are sections of sidewalls 38 and 39, respectively.

Placing device 10 within housing 37 and further housing 37 on the interior of door 11 limits the ability of a potential thief to gain access by use of a sledgehammers. Such a hammer simply cannot reach padlock 24 unless door 11 is compromised.

Bar 13 is limited in its downward movement by engagement of flanged upper end 27 with plate 33 and its upward movement by top sidewall 40. Flanged upper end)27 further serves as a collar under which the end 28 of a pivoted lever 29 which extends to hold bar 13 in the unlocked position as illustrated in FIGS. 2 and 4 (in shadow). In the preferred embodiment, lever 29 is resiliently urged towards bar 13 but is adapted to be moved with finger pressure.

The open end of housing 37 is provided with a flange 50 having a bead 51 extending about its periphery. In the preferred embodiment, bead 51 is comprised of the same hard facing rod solder used in bead patch 55 which cannot be sawn. Flange 50 prevents a potential thief from viewing the components of device 10. Flange 50, in combination with bead 51, limits the ability to use a saw to cut through bar 13 and thereby gain access through door 11.

When a locking procedure is undertaken, lever 29 is pivotally moved by a user's finger to allow bar 13 to move downwardly into sleeve 15 with the narrow portion 25 positioned for receiving shackle 23 of padlock 24. Since the,shear point of bar 13 is weakest at narrow portion 25, that portion 25 is concealed by padlock 24 itself.

The device described is preferably comprised of a strong metal such as a carbon steel though those skilled in the art will recognize that other materials may be suitable for use therewith.

Although only certain embodiments have been illustrated and described, it will be apparent to those skilled in the art that various changes and modifications may be made therein without departing from the spirit of the invention or from the scope of the appended claims.

What is claimed is:

1. A protective device for locking two objects of a cargo container in a fixed relationship comprising:

a housing having an open end and a flange extending about the periphery of the open end, the housing mounted on one of said objects, a longitudinally movable bar mounted on the interior of housing and extending therethrough for cooperatively engaging a sleeve mounted on the other of the objects for locking the objects together, a lower collar mounted on the housing for enclosing the bar, the lower collar having a padlock retainer formed at an end of the lower collar inside the housing for providing a recess which exposes a predetermined hole in the length of the bar when the bar is in cooperative engagement with the sleeve and forms an opening for receiving the shackle of a padlock, the hole adapted to allow the shackle of the padlock to extend through the bar when the bar engages the sleeve, the padlock retainer comprising two parallely spaced members and two retainer side plates forming the recess therebetween, the two retainer side plates and the two parallely spaced members adapted to receive the padlock when it extends through the hole in a narrow portion of the bar, and an upper collar mounted within the housing for enclosed the bar having a keyhole protector formed between its ends for providing a cavity which provides access to a key to a keyhole slot locking and unlocking the padlock, the keyhole protector comprising one of the two parallely spaced members and a third paralelly spaced member and two side plates forming the cavity therebetween, the two side plates, the one of the two paralleley spaced members and the third paralleley spaced member adapted to closely receive the key when inserted therein.

2. The protective device of claim 1 wherein the retainer side plates are angled to closely receive the padlock.

3. The protective device of claim 1 wherein the housing is a box structure.

4. The protective device of claim 1 wherein the bar has a flanged upper end which engages the third parallely spaced member.

5. The protective device of claim 4 wherein an end of a pivoted lever engages the flanged upper end to hold the bar in an unlocked position.

6. The protective device of claim 5 wherein the pivoted lever is resiliently urged towards engagement with the flanged upper end, the pivoted lever being adapted to be moved with finger pressure.

7. The protective device of claim 1 further comprising a bead extending about the periphery of the flange.

8. The protective device of claim 7 wherein the bead is comprised of a hard facing rod solder.

9. The protective device of claim 1 comprised of a hard carbon steel.

10. A protective device for locking two objects of a cargo container in a fixed relationship comprising:

a box housing having an open end and a flange extending about the periphery of the open end, the flange having a hard facing rod solder bead extending along the periphery of the flange, the housing mounted on one of said objects, a longitudinally movable bar mounted on the interior of housing and extending therethrough for cooperatively engaging a sleeve mounted on the other of the objects for locking the objects together, a lower collar mounted on the housing for enclosing the bar, the lower collar having a padlock retainer formed at an end of the lower collar inside the housing for providing a recess which exposes a hole in the bar when the bar is in cooperative engagement with the sleeve, the hole adapted to receive the shackle of a padlock, the hole adapted to allow the shackle of the padlock to extend through the bar when the bar engages the sleeve, the padlock retainer comprising two parallely spaced members and two angled retainer side plates forming the recess therebetween, the two angled retainer side plates and the two parallely spaced members adapted to receive the padlock when it extends through the hole in a narrow portion of the bar, and an upper collar mounted within the housing for enclosing the bar having a keyhole protector formed between its ends for providing a cavity which provides access to a key to a keyhole slot locking and unlocking the padlock, the keyhole protector comprising one of the two parallely spaced members and a third paralelly spaced member and two side plates forming the cavity therebetween, the two side plates, the one of the two paralleley spaced members and the third paralleley spaced member adapted to closely receive the key when inserted therein.

11. The device of claim 10 wherein the bar has a flanged upper end which engages the third parallely spaced member, the end of a pivoted lever engaging the flanged upper end to hold the bar in an unlocked position, the pivoted lever being resiliently urged towards engagement with the flanged upper end, the pivoted lever being adapted to be moved with finger pressure.

* * * * *